United States Patent [19]

Mikkelsen

[11] 4,147,308

[45] Apr. 3, 1979

[54] ROLLER MILL

[75] Inventor: Bent E. Mikkelsen, Copenhagen, Denmark

[73] Assignee: F. L. Smidth & Co., Cresskill, N.J.

[21] Appl. No.: 819,403

[22] Filed: Jul. 26, 1977

[30] Foreign Application Priority Data

Jul. 27, 1976 [GB] United Kingdom ..... 31271/76

[51] Int. Cl.[2] ..... B02C 15/04

[52] U.S. Cl. ..... 241/117

[58] Field of Search ..... 241/114, 117, 119, 121

[56] References Cited

U.S. PATENT DOCUMENTS

| | | | |
|---|---|---|---|
| 65,790 | 6/1867 | Belleville | 227/156 |
| 3,083,920 | 4/1963 | Schauer | 241/114 |
| 3,169,712 | 2/1965 | Schauer et al. | 241/117 |

FOREIGN PATENT DOCUMENTS

| | | |
|---|---|---|
| 853390 | 11/1960 | United Kingdom. |
| 911279 | 11/1962 | United Kingdom. |

*Primary Examiner*—Neil Abrams

*Attorney, Agent, or Firm*—Pennie & Edmonds

[57] ABSTRACT

A vertical roller mill is disclosed for grinding material. The roller mill includes a rotatable grinding table at least one grinding roller resting upon the grinding mill, a pressure frame secured to the grinding roller and a housing which surrounds these elements. A guide mechanism pivotally connected between the pressure frame and the housing resiliently restrains movement of the pressure frame with respect to the housing and thereby reduces the transmission of forces from the pressure frame to the housing.

25 Claims, 5 Drawing Figures

ROLLER MILL

BACKGROUND OF THE INVENTION

1. Field of the Invention

This invention relates to vertical roller mills of the rotatable grinding table type for grinding materials such as cement raw meal.

2. Description of the Prior Art

Vertical roller mills for grinding and drying materials are well known in the art. These mills include a rotary grinding track, grinding rollers (usually three in number) positioned on the track and a housing which encases the track and the rollers. The grinding rollers are pulled downwardly toward the rotary grinding track to provide a desired grinding pressure. Raw material enters the roller mill, falls onto the grinding track and is ground between the surface of the track and the rollers. The ground material is pushed from the grinding track and carried from the mill by a gas flow.

In prior art roller mills, various pressure mechanisms are utilized to cause the rollers to exert adequate grinding pressure on the rotating grinding table. A commonly used pressure mechanism is a pressure frame mounted above the rollers and supported by the rollers. Through hydraulic and/or mechanical means, the frame exerts pressure upon the rollers which exert pressure upon the grinding table. The prior art pressure frame may also be combined with draw bars. The upper end of each draw bar is mounted by movable joints to a corresponding corner of the frame and each lower end of the draw bars is mounted in or on the foundation of the mill. Hydraulic or mechanical pistons and/or telescopic mechanisms may be mounted at the lower ends of the draw bars to produce a downwardly directed force on the frame and ensure the desired pressure of the rollers against the grinding table.

In such pressure mechanisms, the frame must be able to move in a vertical plane within the mill housing to vary the pressure of the roller against the grinding table. However, it is desirable to minimize the movement of the frame in the horizontal plane which results from horizontal turning and twisting forces exerted on the frame. The prior art pressure frame is guided in the mill housing through guideways mounted on the inner wall of the housing, adjacent each corner of the frame. Inside the guideways, both the frame and the housing are provided with vertical sliding surfaces that face each other. These surfaces act as impact plates and absorb a part of the turning and twisting movement of the frame in the horizontal plane. Guide mechanisms are positioned within the guideways and also absorb the turning and twisting forces exerted on the frame, especially in the horizontal plane. These guide mechanisms are designed as strong mountings which are attached to the inner wall of the mill housing. Consequently, the housing must be constructed of strong materials to absorb the very powerful turning and twisting that are transmitted from the pressure frame to the mountings and mill housing. Even these strong mill housings, however, are weakened because of heavy vibrations transmitted to the housing during the operation of the roller mill.

I have invented a roller mill which eliminates the above described difficulties by providing a guide mechanism which substantially reduces the detrimental effects of the twisting and turning forces upon the mill housing.

SUMMARY OF THE INVENTION

This invention provides a roller mill which comprises a mill housing, a rotary grinding table positioned within said housing and having an upper surface defining a grinding path; at least one grinding roller disposed above said grinding table for engaged grinding rotation along said grinding path; and a pressure frame to suspend each grinding roller above said grinding table. The invention also includes means to guide said pressure frame relative to said housing. The guide means have resilient means positioned to resiliently restrain movements of said pressure frame to thereby reduce the transmission of vibrations from said pressure frame to said housing.

Preferably, each guide means comprises an elongated member such as a bar pivotally connected at one end to its own swivel means such as a swivel link which permits movement of each bar in the horizontal plane. Additionally, the two swivel links are pivotally joined perpendicular to the pivotal connection of the bar to the swivel link by a connecting piece and mounted on the corner of the pressure frame to permit movement of each bar in the vertical plane. By resilient mounting means, each bar is resiliently mounted at its other end to the housing for limited movement relative thereto.

Each bar may rest in a separate guideway in the wall of the mill housing to provide a freedom of movement of the bars in the vertical and horizontal planes. The resilient mounting means advantageously are dished disc shaped springs which are positioned in face-to-face engaged relation about the outwardly facing part of each bar and are secured to the bar and the housing. Alternately, the resilient means may be in the form of coil or fluid springs. Pneumatic or hydraulic pressure cylinders may be mounted at this same location on each bar. By making the bars rotatable in relation to their common connecting piece—e.g., by pivots positioned in the vertical plane and disposed at right angles to the individual bar, or by ball joints—and by making the two parts of the connecting piece rotatable in relation to each other—by a pivot positioned in the horizontal plane and fixed to the mountings on the pressure frame—such freedom is achieved for the guide means in relation to the pressure frame that the guide means in addition to its guiding function in the vertical plane may act through its resilient mounting means as a compensator for a substantial part of the turning and twisting forces acting on the pressure frame. The effects of the twisting and turning forces on the walls of the mill housing thereby are reduced.

Alternatively, the guide means may comprise two cables or wires instead of two bars. By resilient mounting means, each wire may be resiliently mounted at one end to the housing for limited movement relative thereto. The other end of each wire then is looped to form an eye and both eyes are mounted on a pivot which lies in a horizontal plane and is fixed to the pressure frame.

The resilient guide means may also comprise impact plates mounted along the side of the mountings on the corners of the pressure frame adjacent the corners of the mill housing. Similarly mounted impact plates may also be positioned opposite the pressure frame impact plates on the inner wall of the corners of the mill housing. The impact plates absorb the energy from the movement of the pressure frame in the horizontal plane and serve as guides in the form of sliding surfaces for directing the vertical movements of the pressure frame.

The guide means of the present invention is particularly applicable when the grinding rollers are mounted transvesely of the side members of the pressure frame opposite each corner of the frame. This arrangement ensures that the twisting forces exerted on each side member substantially are transformed into bending forces which the guide means is capable of absorbing.

BRIEF DESCRIPTION OF THE DRAWINGS

A preferred embodiment of the present invention is described hereinbelow and illustrated in the accompanying drawings, wherein.

DETAILED DESCRIPTION OF THE PREFERRED EMBODIMENT

Figure 1A:
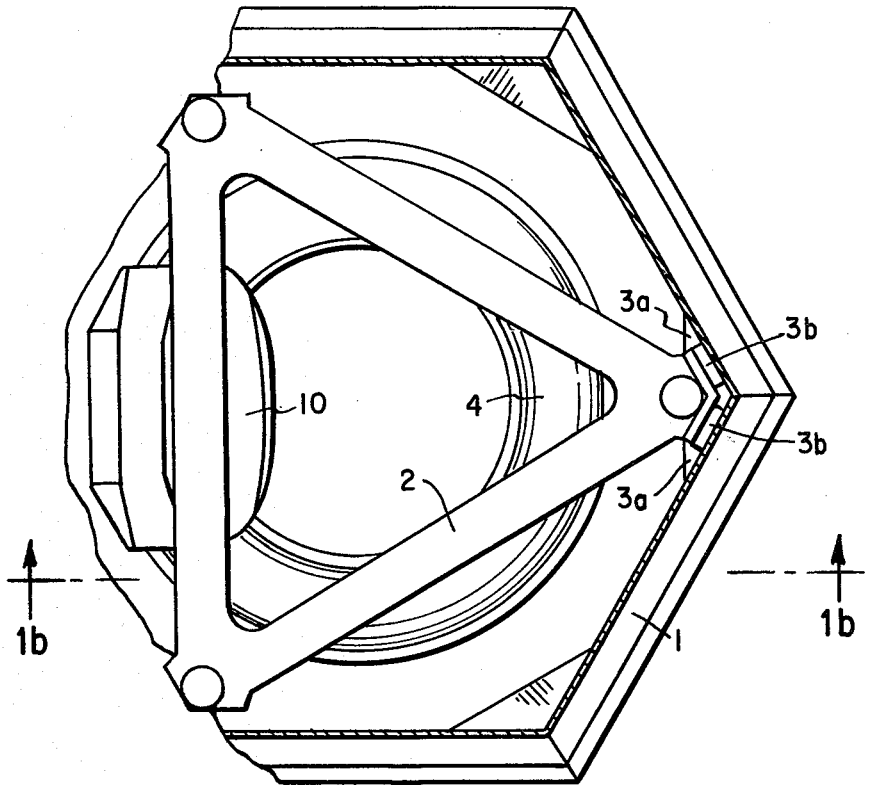
FIG. 1a PRIOR ART
FIG. 1*a* is a sectional plan view, of a roller mill according to the prior art.
Figure 1B:
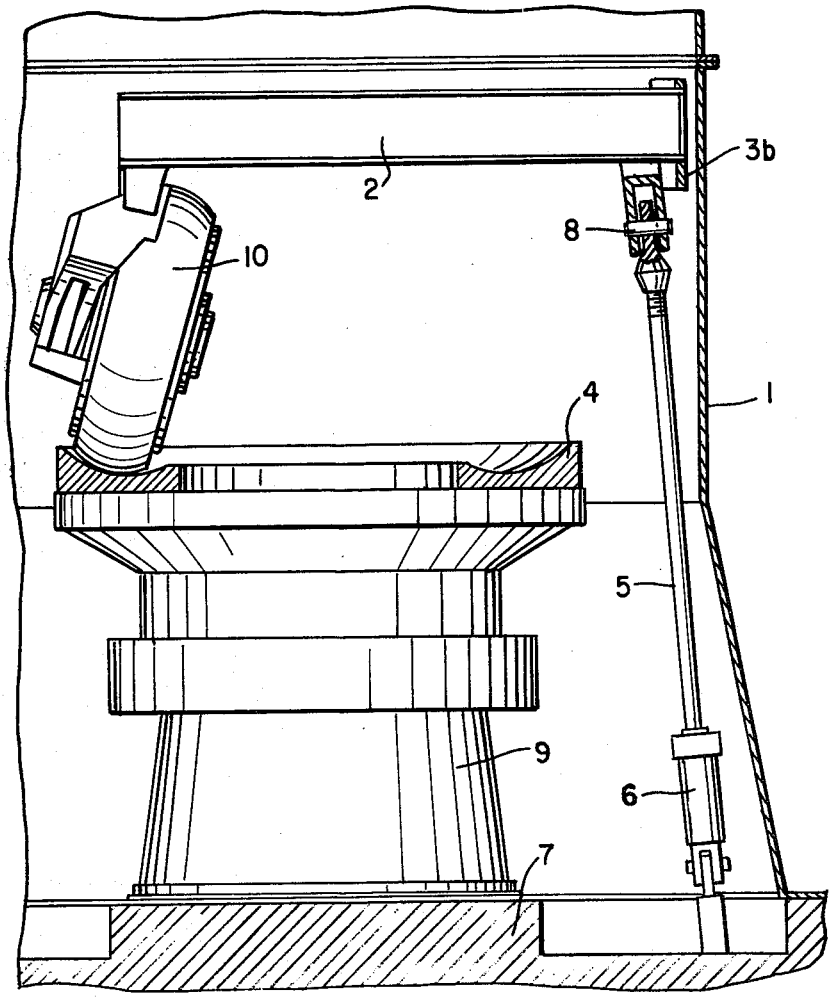
FIG. 1b PRIOR ART
FIG. 1*b* is a sectional view taken along line 1*b*—1*b* of FIG. 1*a;*

FIGS. 1*a* and 1*b* illustrate a vertical roller mill of the prior art. The roller mill includes a housing 1, a pressure frame 2, grinding rollers 10 (only one is shown) a horizontal rotary grinding table 4, a support 9 and a mill foundation 7. Pressure frame 2 is an example of a prior art pressure mechanism wherein grinding rollers 10 are suspended below side members of pressure frame 2 between the frame corners and parallel with the sides of the frame. Pressure frame 2 is located inside housing 1 of the mill and is provided with draw bars 5 which are positioned at each corner of the pressure frame. By means of a piston mechanism 6, such as a tension cylinder, and movable links 8, draw bars 5 subject pressure frame 2 and grinding rollers 10 to a downwardly directed force which presses the rollers against the concave surface of rotating grinding table 4 at a desired grinding pressure. Draw bars 5 are mounted in or on foundation 7 of the mill. Support 9 rests on the foundation and supports grinding table 4.

During its upward and downward movement in the housing, pressure frame 2 is guided in the horizontal and the vertical planes by guideways 3*a* which are provided at the corners of housing 1. Within the guideways, both housing 1 and pressure frame 2 are fitted with impact plates or slide plates 3*b* for absorbing some of the movements of frame 2 against the inner wall of housing 1.

Figure 2:
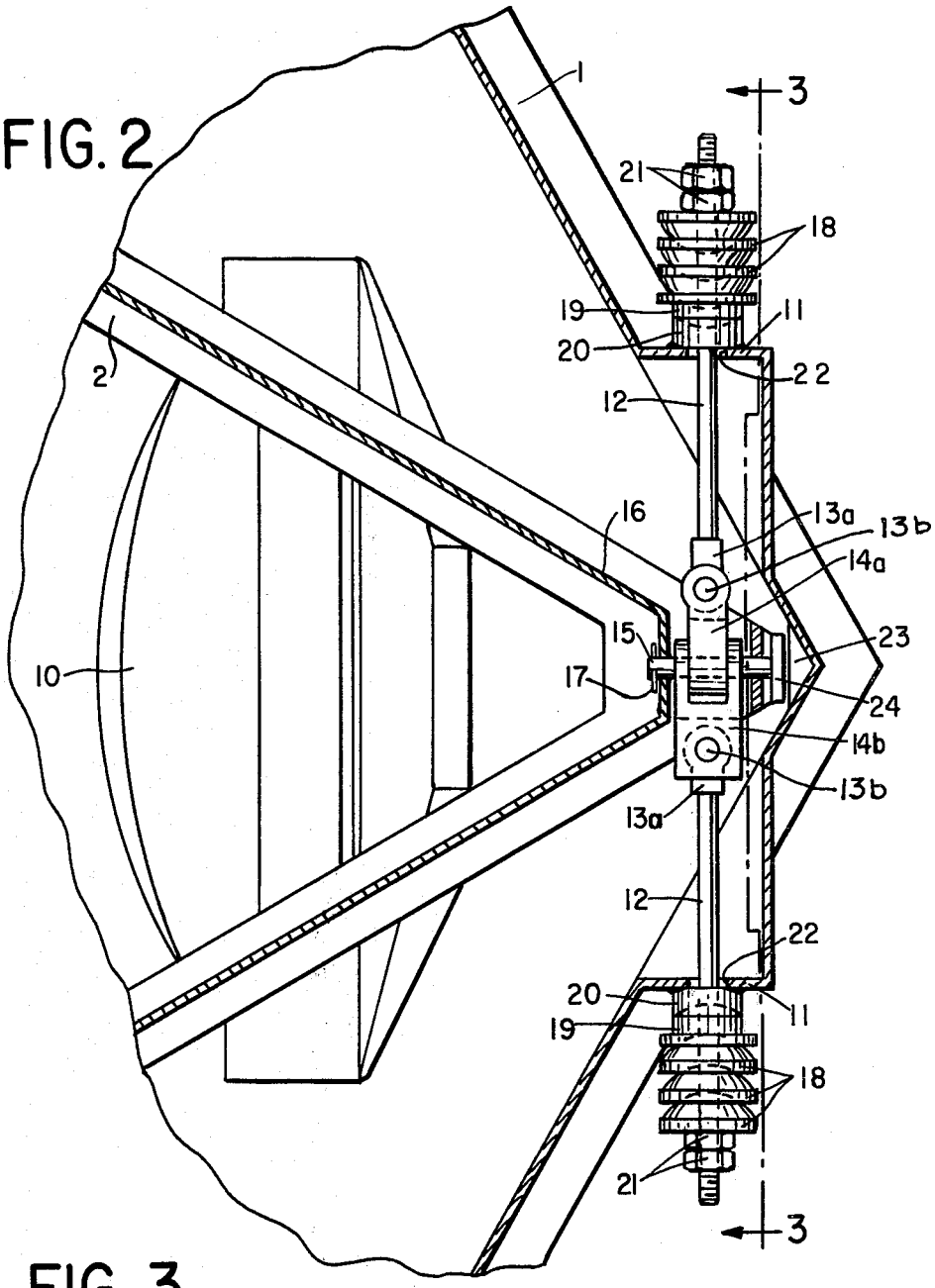
FIG. 2 is a plan view, partially in section, of a corner portion of a roller mill constructed according to the invention.
Figure 3:
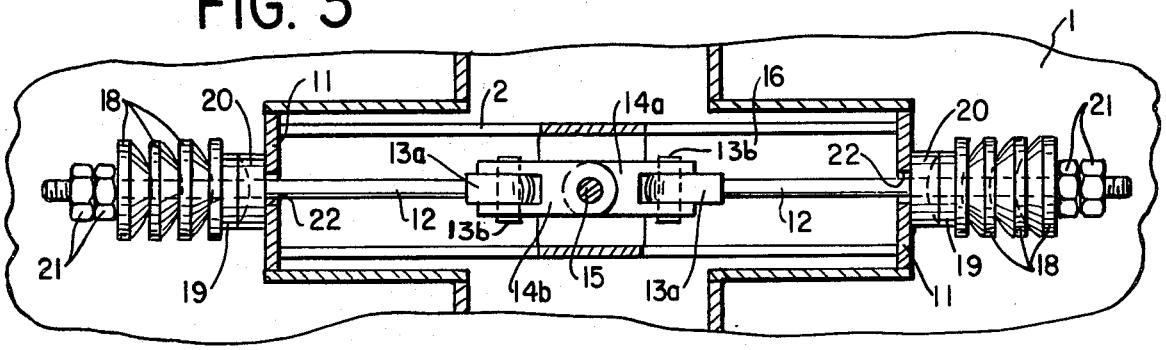
FIG. 3 is a view, partially in section, taken along line 3—3 of FIG. 2.

FIGS. 2 and 3 illustrate a guide mechanism for roller mills according to the present invention. There is shown a corner of a housing 1 adjacent a corner of a pressure frame 2, a guideway 11 welded into the wall of the housing, a guide mechanism positioned between the guideway and the frame, and grinding rollers 10 (only one is shown) located beneath pressure frame 2 in general alignment with the side members thereof and opposite each corner of the frame.

Twisting, turning and sliding movements of the pressure frame in relation to mill housing 1 are controlled at each corner where pressure frame 2 and housing 1 intersect by the guide mechanism. This mechanism includes two identical bars 12 having their longitudinal axis generally positioned in a horizontal plane. Each bar is connected at its inner end to a swivel link illustratively comprising swivels 13*a*, pivot 13*b* and forked ends of connecting members 14*a* and 14*b*. As shown, pivots 13*b* are disposed in a vertical plane perpendicular to the longitudinal axis of bar 12. As a result, bars 12 swivel in a horizontal plane about pivots 13*b*.

To permit bars 12 to rotate in a vertical plane, the other ends of connecting members 14*a* and 14*b* are separate parts of an articulate connecting piece. Illustratively, this other end of connecting member 14*b* is forked and this other end of connecting member 14*a* is undivided. By means of a pivot 15, these two ends of connecting members 14*a* and 14*b* are pivotally joined to rotate in the vertical plane. As shown, pivot 15 is disposed in a horizontal plane, rests in a body 16 of pressure frame 2 and is retained in position by a lock plate 17.

The outer ends of bars 12 project through bores 22 of guideway 11. The diameter of each bore 22 is larger than the diameter of each bar 12 to permit movement of the bars in the horizontal and the vertical planes. Guideway 11 has on its outer surface an abutment 20 which is positioned around bore 22. A shoulder 19 of each bar 12 rests on abutment 20. The surface of the shoulder which faces pressure frame 2 may be spherical to ensure the free movement of bar 12 in relation to guideway 11.

For absorption of the upward and downward directed forces and the turning and twisting forces acting on the guide mechanism and consequently on the mill housing, the ends of bar 12 which project from guideway 11 illustratively are provided with disc springs 18 such as dished configured disc type springs known as Belleville washers. Such a spring is comprised of a plurality of such dished washers positioned in stacked relation preferably as shown, with the result that the spring has a substantial spring rate with washer-to-washer friction—as well as basic washer resistance—providing a dampening or energy absorbing effect. The springs are positioned adjacent the outer surface of shoulder 19. Advantageously, this surface is flat. The springs are retained at a desired compression by nuts 21.

To further absorb the turning and twisting forces, the outer surface of the corner proper of pressure frame 2 is provided with an impact plate 24 which cooperates with an impact plate 23 provided on the inner wall of the corner of the mill housing. As shown, grinding rollers 10 are arranged transversely of the side members of pressure frame 2. This arrangement constitutes in itself less strain to the pressure frame than the prior art arrangement with the rollers positioned parallel to the side members.

Figure 4:
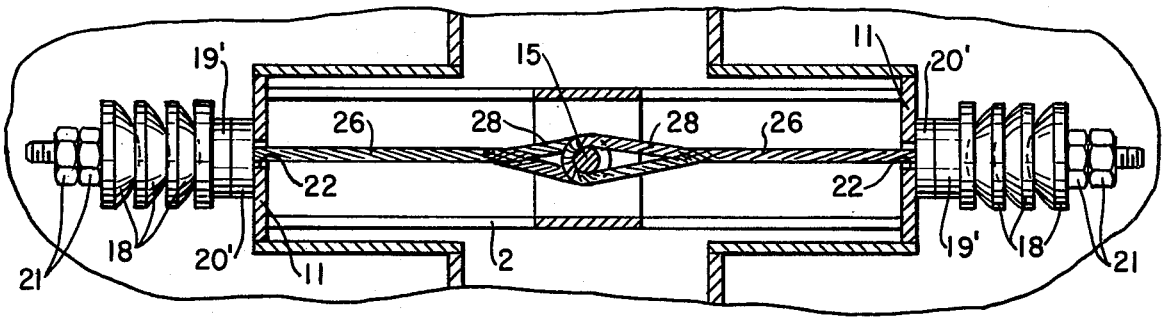
FIG. 4 is a view, partially in section, similar to the view shown in FIG. 3 and illustrating an alternate embodiment of the invention.

While the invention has been described in conjunction with a certain embodiment, it is to be understood that various modifications and changes may be made without departing from the spirit and scope of the invention. For example, each bar 12 may be replaced by a wire or cable 26, as shown in FIG. 4, and the outer end of each wire can be resiliently mounted in an associated guideway 11 in a similar manner as the bars 12 are mounted in the embodiment of FIG. 3. However in the embodiment of FIG. 4, it can be seen that the surface of the shoulder 19' which faces the pressure frame 2 does not have a spherical configuration, but is configured to engage the corresponding flush surface of abutment 20'. At its inner end, the wire may be looped to form an eye 28 through which above described pivot 15 passes. The eye 28 and the pivot 15 substitute for swivels 13*a*, pivots 13*b*, and connecting members 14*a* and 14*b*. Further, the disc springs may be replaced by any suitable resilient member such as a mechanical spring or a fluid spring which absorbs the damaging forces exerted upon the housing.

I claim:

1. A roller mill which comprises:
   a. a mill housing;
   b. a rotary grinding table positioned within said housing and having an upper surface defining a grinding path;
   c. at least one grinding roller disposed above said grinding table for engaged grinding rotation along said grinding path:
   d. a pressure frame to suspend each grinding roller above said grinding table; and
   e. means to guide said pressure frame relative to said housing, said guide means having resilient means positioned to resiliently restrain movements of said pressure frame to thereby reduce the transmission of vibrations from said pressure frame to said housing.

2. The roller mill according to claim 1 wherein said guide means comprises:
   a. an elongated member positioned in a substantially horizontal plane and having its end portions resiliently mounted to the mill housing; and
   b. swivel means connected to the pressure frame and to said elongated member so as to divide said member into two elongated submembers, said swivel means permitting the submembers to rotate in vertical and horizontal planes and thereby absorb vibratory energy transmitted by forces from the pressure frame to the mill housing.

3. The roller mill according to claim 1 wherein said guide means comprises:
   a. at least two elongated members positioned in a substantially horizontal plane, each member having an outer and inner end portion;
   b. means for resiliently mounting each outer end portion of said elongated members to the mill housing; and
   c. swivel means rotatably connected to said pressure frame and to each inner end portion of said elongated members to allow said members to rotate in horizontal and vertical planes about said swivel means and thereby absorb energy transmitted by forces from the pressure frame to the enclosing means.

4. The roller mill according to claim 3 further comprising at least one guideway secured to the portion of the mill housing adjacent said guide means, said guideway having at least two openings positioned to receive said elongated members and dimensioned to permit movement of said elongated members in horizontal and vertical planes.

5. The roller mill according to claim 3 wherein the swivel means comprises two swivel links, each link being rotatably connected to a respective inner end portion of said elongated members and positioned to permit said elongated members to rotate in a horizontal plane, each swivel link being rotatably connected together by at least one pivot member positioned to permit rotation of the elongated members in a vertical plane.

6. The roller mill according to claim 3 wherein said swivel means comprises:
   a. two swivel links, each swivel link including a swivel member pivotably connected to the inner end portion of an associated elongated member, a pivot member positioned in a generally vertical plane and a connecting member having a forked end portion, said pivot member rotably connecting said swivel member to said connecting member to permit said elongated member to rotate about said pivot member in a horizontal plane; and
   b. means to secure said swivel links together so as to permit movement of said elongated members in a vertical plane.

7. The roller mill according to claim 6 wherein said means to secure said swivel links comprises a pivot member positioned in a horizontal plane and rigidly secured to said pressure frame, each connecting member being configured to surround the pivot member and rotate in a vertical plane around the pivot member.

8. The roller mill according to claim 3 wherein said resilient mounting means comprises a mechanical spring.

9. The roller mill according to claim 3 wherein said pressure frame has a generally triangular configuration and is disposed in a horizontal plane above said rotatable grinding table.

10. The roller mill according to claim 9 wherein the guide means further comprises at least one impact plate mounted on a corner of the frame and positioned to face the adjacent portion of the mill housing, and at least one corresponding impact plate mounted on the mill housing adjacent to the pressure frame impact plate, said impact plates being adapted to absorb the energy of forces exerted from the pressure frame toward the mill housing.

11. The roller mill according to claim 3 wherein the resilient mounting means comprises at least one mechanical spring.

12. The roller mill according to claim 2 wherein the mechanical spring comprises a plurality of dished disc springs.

13. The roller mill according to claim 3 wherein each elongated member comprises a wire and the end portion of each wire is looped about itself to form an eye being disposed opposite each other and having a pivot pin disposed in a horizontal plane within both eyes to form said swivel means and to permit said wires to rotate in vertical and horizontal planes about said pivot pin.

14. The roller mill according to claim 9 wherein each grinding roller is positioned transverse to a corner of the pressure frame.

15. The roller mill according to claim 6 wherein there are three grinding rollers.

16. A vertical roller mill which comprises:
   a. a rotatable grinding table having an endless path;
   b. a pressure frame having at least three side members secured together to form a generally triangular configuration, said pressure frame being disposed above the endless path of said grinding table;
   c. at least three grinding rollers secured to the side members and positioned on said grinding table for grinding rotation along said endless path;
   d. a housing to enclose said grinding table, grinding rollers and pressure frame; and
   e. at least three guide means secured to a respective corner of said pressure frame and to an adjacent portion of said housing, each guide means including:

i. two bars each having an inner and outer end portion;

ii. two swivel links, each connected to the inner end portion of a respective bar to permit rotation about the swivel link in a horizontal plane;

iii. two connecting members, each connected to a respective swivel link;

iv. means secured to the corner of the pressure frame for rotatably connecting together each connecting member to permit rotation of the bars in a vertical plane; and v. means for resiliently mounting each outer end portion of the bars to the housing, said guide means thereby absorbing vibratory energy of turning and twisting forces exerted from the pressure frame to said housing.

17. The vertical roller mill according to claim 16 wherein said resilient mounting means comprises a mechanical spring which resiliently secures each outer end portion of said bars to said housing.

18. The vertical roller mill according to claim 17 wherein said guide means further comprises at least one impact plate mounted on an inner surface portion of said housing adjacent a corner of the pressure frame and at least one corresponding impact plate mounted on said corner of the frame and positioned in face-to-face contact with the housing impact plate to absorb vibratory energy from forces exerted on the housing by the pressure frame.

19. The roller mill according to claim 18 wherein each grinding roller is mounted transversely of the side members of the pressure frame opposite each corner of the pressure frame.

20. A vertical roller mill which comprises:

a. a mill housing;

b. a rotary grinding table positioned within said housing and having an upper surface defining an endless grinding path;

c. at least three grinding rollers disposed above said grinding table for engaged grinding rotation along said grinding path;

d. a pressure frame to suspend each grinding roller above said grinding table, said pressure frame having at least three side members secured together to form a generally triangular configuration; and e. at least one guide means secured to each corner of the pressure frame and to an adjacent portion of the housing, each guide means including:

i. two wires each having an inner and outer end portion, ii. means for resiliently mounting each outer end portion of the wires to the housing;

iii. a pivot member secured to a corner of the pressure frame; and iv. means to rotatably secure both inner end portions of the wires to said pivot member, said guide means thereby absorbing vibratory energy of turning and twisting forces exerted from the pressure frame to said housing.

21. The vertical roller mill according to claim 20 wherein the resilient mounting means comprises a mechanical spring which resiliently secures each outer end portion of the wires to the housing.

22. The vertical roller mill according to claim 21 wherein the inner end portion securing means comprises having each inner end portion of the wires looped upon itself to be formed into an eye shaped configuration which surrounds the pivot member.

23. The vertical roller mill according to claim 22 wherein the guide means further comprises at least one impact plate mounted on the inner surface of the housing adjacent a corner of the pressure frame and at least one corresponding impact plate mounted on said corner of the frame and positioned for face-to-face contact with the housing impact plate to absorb energy from forces exerted on the housing by the pressure frame.

24. The roller mill according to claim 23 wherein each grinding roller is mounted transversely of the side members of the pressure frame opposite each corner of the pressure frame.

25. The roller mill according to claim 24 wherein said mechanical spring comprises a plurality of dished belleville washers positioned in stacked contacting relation.

* * * * *